US009038818B1

(12) United States Patent
Selker

(10) Patent No.: US 9,038,818 B1
(45) Date of Patent: May 26, 2015

(54) DEVICE AND METHOD FOR SANITARY CAN PACKAGING

(76) Inventor: Ted Selker, Palo Alto, CA (US)

( * ) Notice: Subject to any disclaimer, the term of this patent is extended or adjusted under 35 U.S.C. 154(b) by 298 days.

(21) Appl. No.: 13/423,214

(22) Filed: Mar. 17, 2012

(51) Int. Cl.
*B65D 75/00* (2006.01)
*B65D 75/30* (2006.01)

(52) U.S. Cl.
CPC ..... *B65D 75/006* (2013.01); *B65D 75/30* (2013.01)

(58) Field of Classification Search
CPC ..... B65D 75/00; B65D 85/62; B65D 11/00
USPC ..... 206/151, 150, 153, 145, 427
See application file for complete search history.

(56) References Cited

U.S. PATENT DOCUMENTS 3,200,944 A * 8/1965 Rapata ..... 206/161
4,523,676 A * 6/1985 Barrash ..... 206/150
2008/0138473 A1 6/2008 Pawlick
2010/0104701 A1* 4/2010 Ibe et al. ..... 426/129
2010/0285180 A1* 11/2010 Gaylor et al. ..... 426/88

* cited by examiner

*Primary Examiner* — Anthony Stashick
*Assistant Examiner* — Raven Collins
(74) *Attorney, Agent, or Firm* — Kim Rubin Patent Agent

(57) ABSTRACT

A method for sanitary beverage can packaging incorporates a plastic sanitation sheet between the tops of the beverage cans and a plastic can retainer. The sanitation sheet covers the tops of the cans, protecting them from dust and overhead spills. Some embodiments use a watertight or airtight seal of the sanitation sheet around the can rim. Some embodiments include visible indicators of seal breakage or direct contamination, using moisture or oxygen detection. Some indicators create a hole in the sanitation sheet. Other indicators provide visible warning text or symbols. The sheet and indicators provide both actual contaminant protection and visible indication of contamination. Embodiments include the plastic sanitation sheet, integration with beverage cans, and a method for use in providing assured sanitary cans to consumers.

10 Claims, 3 Drawing Sheets

PRIOR ART

DEVICE AND METHOD FOR SANITARY CAN PACKAGING

BACKGROUND OF THE INVENTION

Currently, cans containing soft drinks and other consumable beverages are frequently packaged in groups, often six cans in a group, where each group is held together by a removable plastic retention top. The retention top has holes sized to hold each can under normal movement, yet allow each can to be removed from the retainer by a firm pull. The retention top also has holes sized for fingers for carrying the group of cans.

The holes in the plastic retention top that hold the cans leave most of the can top exposed. This exposure permits dust and other contaminants, including bacteria, chemicals and other invisible contaminants, to adhere to the top of the can. Many beverage cans are used as the final container for the beverage and are drunk from directly. This means the consumer of the beverage is placing his or her mouth on the surface of the can. Thus, the beverage consumer is exposed to and consumes contaminants on the can top. Carbonated beverages often foam out of the can onto the top of the can, thereby dissolving and absorbing any contaminants into the beverage.

SUMMARY OF THE INVENTION

This invention packages a group of cans with an intermediate plastic sanitation sheet between the cans and a retention top ("retainer"), thereby protecting the surface of the cans from contamination while not impeding the purposes of the retainer.

In addition to actually protecting the can top from contamination, the invention permits the store staff, the customer and the final beverage consumer to observe that the cans are sanitary. In one embodiment additives ("indicators") are used on the sanitation sheet to indicate by a color change some types of contamination, such as water-based contaminants, or a broken air seal.

DETAILED DESCRIPTION OF THE INVENTION

Figure 1:
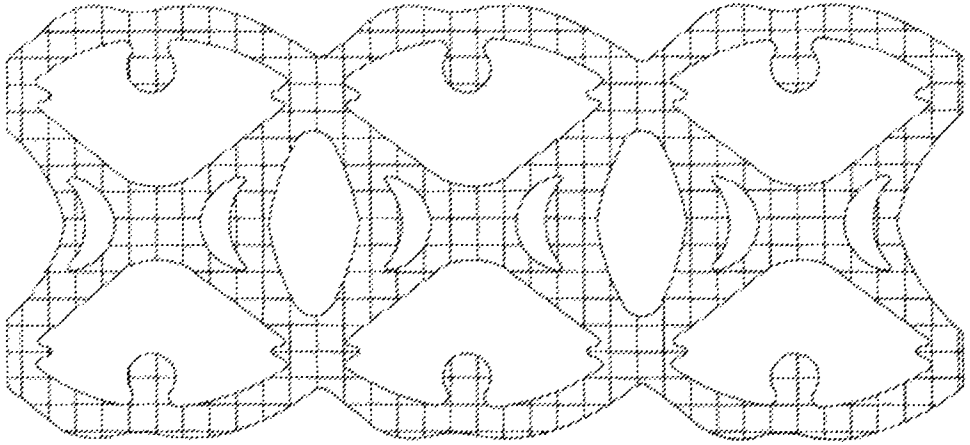
FIG. 1 shows prior art.

This invention comprises a plastic sanitation sheet placed between beverage cans and a plastic retention top. The sanitation sheet is held firmly against the can rim by the plastic retention top ("retainer").

In one embodiment a full seal is not created between the sanitation sheet and the can rim. This sanitation sheet protects against contaminants spilled from above, such as water or beverages. This sanitation sheet protects against dust, dirt, paper or cardboard fragments that might settle from the air onto the can top. This sanitation sheet protects against bacteria from fingers touching the can top. This sanitation sheet protects against bacteria from people coughing above the sanitation film. The loose edges of the sanitation sheet hang freely near the sides of the cans facing the outside of the group, providing some protection from contaminants moving through the air sideways.

One embodiment relates to a single beverage can. A traditional plastic retention top is not normally used for single cans, such as might be dispensed from a vending machine, because the primary purpose of the retention top is to group a plurality of cans. However, in this application the retention top serves the purpose of holding the sanitation sheet in place. Thus, in this embodiment, sanitation may be preserved and visibly assured for single cans, including vending, without changing current beverage manufacturing operations, nor the convenience and familiarity of customers, nor the ability to readily recycle the used can.

In another "water sealed" embodiment a water-tight seal is created between the can rim and the sanitation sheet by the pressure from the retention top and the conformal nature of the sanitation sheet to the rim. Other methods of creating water-tight seals are possible. For example, adhesives may be used, or heat or pressure bonding. A suitable adhesive is a non-toxic, water-soluable adhesive. For example, sugar may be used as an adhesive. Thus, in addition to protecting the can top from the above described contaminants, this embodiment also protects against splashed contaminants, and airborne liquids, such as droplets from coughs or splashes from rain, manufacturing operations, transport operations or store cleaning.

This water sealed embodiment may incorporate chemicals, safe for humans to consume in trace quantities, that indicate the presence of water. Such chemicals are well known. In one embodiment the chemicals are placed in paper, in an absorbent layer, or between the plastic substrate of the sanitary sheet and a water-porous mechanical layer to mechanically isolate such chemicals from contact with the can top.

In another "hermetic" embodiment an airtight seal is created between the can rim and the sanitation sheet. The seal may be created by any combination of pressure by the retention top, adhesive, or heat sealing. How the sanitation sheet is attached, if at all, to the can rim, should be such that the sanitation sheet is removable by the consumer of the beverage.

In the hermetic seal embodiment a chemical or biological indicator may be used to indicate that the seal is broken. One mode is to provide a color change visible to a customer or beverage consumer due to the presence of oxygen. The sanitation sheet is applied to the cans, in the manufacturing process, in an oxygen free atmosphere, typically nitrogen. Such oxygen-sensing chemicals or biological indicators are well known in the art. They may be derived from apples or potatoes, for example, which also provides the consumer with confidence of consumability, should some of the indicator find its way to the can surface. In one mode, such indicators are affixed to the sanitation sheet so that the indicator is removed from proximity to the can when the sanitation sheet is removed.

One such oxygen-sensing indicator is a porous phosphorescent coordination polymer. Other indicators include compounds that oxidize rapidly or spontaneously burn in the presence of air. One example is phosphorus. A very tiny amount of phosphorus may be placed on inside surface the sanitation film. Exposure to oxygen causes the phosphorus to burn, causing a visible hole in the film. In one embodiment the film is stretched tight, so that even a small hole rapidly enlarges. The quantity of phosphorus (or other spontaneously burning agent) is too small to cause injury or risk to consumers.

For this and other embodiments, it is helpful to stretch the sanitation sheet tightly as the cans-sanitation-sheet-retainer combination (see FIG. 2) is assembled. Any small puncture in the sanitation sheet, even without other contamination, is then visible because the puncture point expands.

We refer to any chemical, biological or mechanical indicator that changes its color, reflectivity, transmissivity, texture or contrast due to the presence of moisture, pH change, or oxygen in this application as an "indictor." A "negative" indicator is where the seal is unbroken, un-penetrated, or no contaminant has been detected. A "positive" indicator means the seal has been broken, penetrated, or a contaminant has been detected.

An indicator that is particularly simple for consumers to appreciate is a moisture indicator. Many such indicators are well known. For example, silica gel, a form of silicon dioxide, may be used. A "self-indicating," non-toxic type of silica gel is preferred, such a methyl violet indicator. However, a toxic indicator may be used when the indicator can be mechanically isolated from coming in contact with the can lid.

In one embodiment using methyl violet, which changes from orange (negative) to violet (positive) when hydrated, is to place the methyl violet silica gel in the form of an "X" against an benign orange background, where the background color is closely matched to the negative, dry color of the indicator. The "X" shape is then functionally invisible. When the indicator is hydrated, a violet X appears against the orange background, warning the buyer or consumer that moisture has entered the space between the can top and the sanitation sheet.

Note that it is not necessary for a perfect seal to be formed between the can rim and the sanitation sheet in this embodiment. The air (or other dry gas) used during manufacturing will mix slowly with the ambient air due to permissible small leaks. Extended periods of time in high-humidity environments, as well as being exposed to splashed water, may trigger a positive indication, even if no other contamination occurred. However, such splashed water is rarely clean, and high-humidity environments are generally unhealthy, often containing mold and other contaminants. Thus, such positive indication is not really a "false positive," but rather an indication of likely poor handling or excessive storage time.

Another embodiment uses non-toxic mold spores as a moisture indicator. A colored mold is used for this application. All other non-water nutrients necessary for the mold to reproduce are provided as part of the applied or manufactured indicator. During manufacturing the mold is kept dry. If the small number of mold spores in the indicator are exposed to moisture, they rapidly reproduce and become a visible colony. Many molds are commonly used in food production. A mold for this purpose may be genetically altered to make its color more visible, to add color, or add other indications, such as fluorescence. Such alterations are well known in the art, for example, GloFish®. An ultraviolet light may be used in a store, checkout register, or vending machine to assist in recognition of such an indicator. This indicator is particularly suitable for use in automatic contamination detection systems.

Yet another particularly interesting moisture sensor is a fine coating of powder on a transparent or reflective substrate. Moisture disrupts the uniform dispersal of the powder on a surface, causing the surface to change from translucent to transparent, or causes other patterns to appear. Such power coatings with this attribute are known in the art and have been used as imaging surfaces in camera viewfinders.

The indicator may be transparent or invisible when negative. Then the indicator may change to opaque, translucent or colored when it is indicating. Or, the reverse polarity of indication may be used.

In one mode the indicator is applied so that a text or graphic symbol warning is visible when the indicator is positive. Or, the indicator may be opaque in the negative mode and transparent in the positive mode, then exposing printed text or a graphic underneath.

For example, the text, "SEAL BROKEN" may be then visible when the indicator is positive. A usable symbol might include the well-known circle with a slash through it to indicate, "no." Another usable symbol might be an, "X." The text or graphic may comprise the indicator itself. It may be printed on the sanitation sheet, on an intermediate layer, or on the can top by any of many well known printing techniques, such as silkscreen, lithography, or ink-jet printing. Alternatively, the indicator might be normally opaque, masking the text or graphic, and then become clear when the indicator is positive.

In one embodiment the indicator comprises an indication of acidic pH. The can top and sanitation layer are normally delivered with a neutral, alkaline, or non-existent pH. Skin typically has a pH of 4.5 to 6.0. Such an appropriate pH indicator, indicating positive with a pH less than 6.0, shows positive in the presence of a fingerprint. Carbonated drinks, which make up a large fraction of drinks sold in cans, typically have a pH of 3 to 4. Beer has a pH typically of 3.7 to 4.1. Thus, an indicator that indicates positive in the presence of an acid such as a fingerprint would also show any leaks or spills of many beverages. There are many known indicators that become visible in the presence of a fingerprint. There are many known indicators visibly responsive to pH.

In one embodiment the indicator comprises an indication of sugar. Many soft drinks and beer contain sugar. Most human sweat, such as fingerprints, also contains sugar. Such an indicator would typically show any spill of leak of such beverages, as well has handling of the can top without gloves. One such indicator might be biological, and further might be a cell that reproduces in the presence of sugar. Other reproductive needs of the cell would then be provided in this embodiment, but not the sugar. A small number of cells, not normally visible, may be used as the indicator. Reproduction of these cells to a large numbers of cells would then be visible as a positive indicator. One suitable cell is yeast.

In one embodiment the indicator is applied directly to the surface of the sanitation sheet that faces the can top. In another embodiment, the indicator is applied directly to the can top. In other embodiments, the indicator is embedded within a substrate, or sandwiched between a substrate and the sanitation sheet, as a lamination.

A suitable substrate for some applications is one that is hydrophilic, so as to attract and hold any moisture, as water is a common component in many contaminants. Such a substrate may be paper, cellulose based, or preferably comprise a superabsorbent polymer, such as commonly used in tampons and diapers. Such superabsorbent polymers may be in the form of a hydrogel. The indicator may be dispersed within the substrate, or a sandwich may be used where the layer of the sandwich facing the can top does not contain the indicator so as to protect the can top from contact with the indicator. The inner layer of the sandwich comprises the indicator. The upper layer of the sandwich is the sanitation sheet. This "sandwich" may be called a lamination. Additional layers and compounds may be used in the lamination, such as adhesives or additives to enhance the effect of the indicator.

In one embodiment the indicator is applied broadly, approximating the area of the can top and/or rim. In an alternative embodiment the indicator is applied selectively, such as in the form of text, a graphic icon, or in a ring.

Please refer now the Figures.

FIG. 1 shows the prior art, an overhead view of a flat plastic retention top commonly used to secure six soft drink or beer cans, a "six pack," into a group. The large openings conform to the round can tops when the cans are inserted. The mid-sized openings are commonly used for finger grips for carrying the six-pack.

Figure 2:
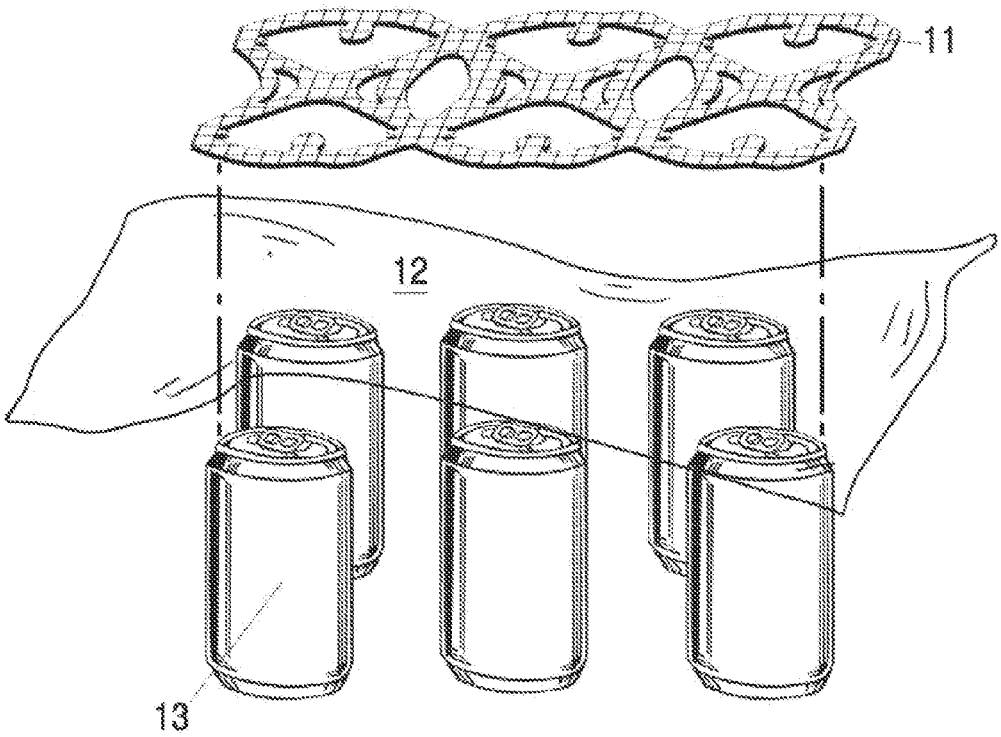
FIG. 2 shows an exploded view of the invention.

FIG. 2 shows an exploded view. The plastic retention top 11 is shown flat, before applying it to the six cans 13. The sanitation sheet is shown 12 in between the retention top 11 and the cans 13. Note that in a simple embodiment, no indicators or markings are used. The plastic sanitation sheet provides physical protection against most contact, spills, and dust.

Figure 3:
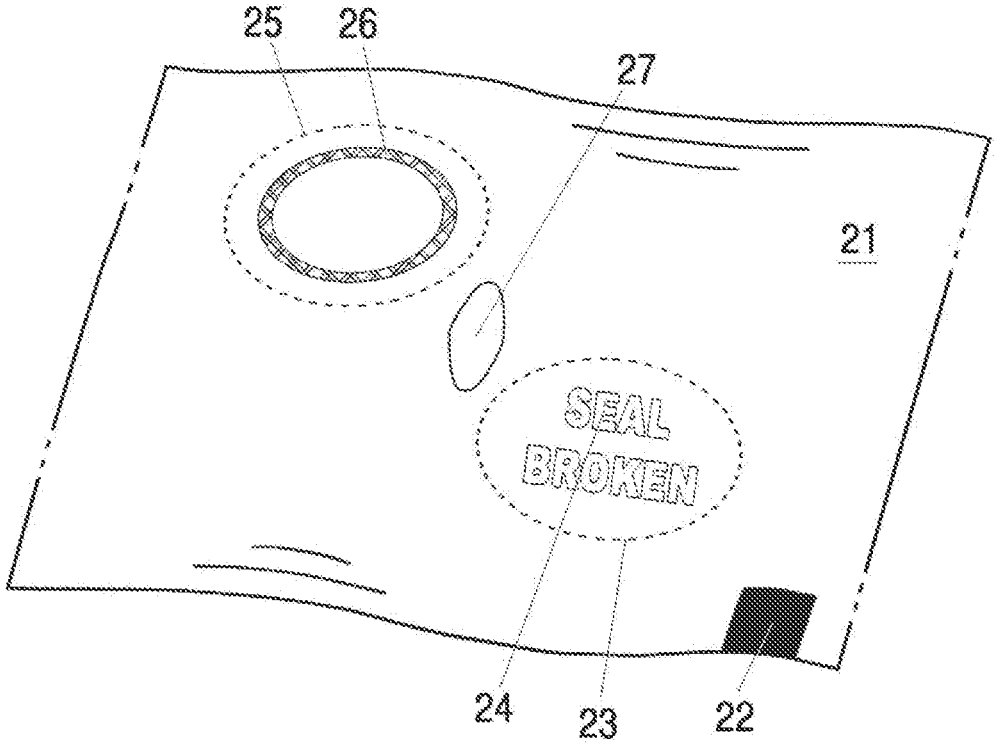
FIG. 3 shows embodiments including printed indicators and a finger hole.

FIG. 3 shows several variations of embodiments. The elements in this Figure are not to scale nor to position. 21 is the sanitation sheet. It is typically manufactured from a roll, as shown by broken edges at the left and right edges of the sanitation sheet. 22 is an optional optical mark used during manufacturing to align elements of the sheet with steps or processes, such as printing, lamination, cutting, and application to the cans. 23 is a dotted outline showing approximately the location of one can rim when the sanitation sheet is assembled over a can. 24 shows one embodiment of an indicator, here shown as open type with the words, "SEAL BROKEN" which will become visible type if the indicator becomes positive, otherwise remain invisible while the indicator is still negative.

25 and 26 in FIG. 3 show a different embodiment detail. 25 is a dotted outline showing approximately the location of one can rim when the sanitation sheet is assembled over a can. 26 shows a ring area of an indicator that is a lamination of multiple components.

27 in FIG. 3 shows one embodiment of a finger hole. Typically, these finger holes line up with the finger holes in the plastic retention top so that the normal method of carrying a group of cans constrained by the retention top is unimpeded.

Figure 4:
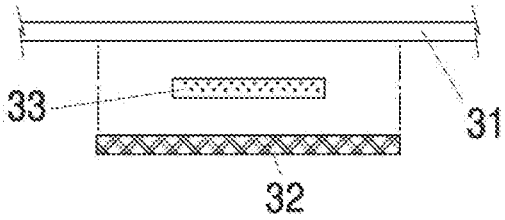
FIG. 4 shows an embodiment of a laminated indicator.

FIG. 4 shows one embodiment of a lamination or "sandwich" of an indicator on the sanitation sheet comprising the sanitation sheet base 31, the indicator 33, which may be in a substrate, matrix, carrier or hydrogel for this layer; and 32 a protective and covering layer. Layer 32 isolates the indicator (or indicator layer) 33 from contacting the can top directly, while allowing the desired contaminants (or water or oxygen as indication of seal breakage) to reach the indicator. The orientation of the layers in FIG. 4 has the surface of the sanitation layer 31 exposed to the world (not shown) uppermost in the Figure, and the can top (not shown) lies below 32. Layer 32 is typically an open matrix of benign material, such as paper or an open-weave or porous polyethylene.

Of particular concern to some consumers of canned beverages is the cleanliness of the cans dispensed by vending machines. The vending machines are typically hand loaded by a technician who services multiple vending machine locations and usually drives a truck between vending machine locations. It is reasonable to expect that this technician does not have clean hands. In the process of loading the cans into the machine the technician has a high likelihood of touching at least one can top.

This invention may be used to assure a consumer of a vended drink can that the top of the can is clean. The individual cans are manufactured with the sanitary sheet described as one embodiment of this invention. The cans are individually vended with the sanitation sheet intact.

The vending machine may have an automatic means, such as a camera, to detect if an indicator on a can is reading positive. The machine may then refund the customer's money or vend a second can.

Single can embodiments of this invention are also useful in airplanes, where single cans are often provided to passengers. The tight spaces of airplanes make contamination particularly likely, for example, water droplets on the can top from the coughing of other passengers.

DEFINITIONS

"Changes state"—refers to a contamination indicator that changes so as to indicate or not indicate contamination. Such a change may be invisible to visible, change of color, change of material, or vice versa.

"Does not comprise oxygen"—means a sufficiently small amount of oxygen so as to not trigger a positive indication from an oxygen indicator. The type of nitrogen gas commonly used in sealed food packaging is typically suitable.

"Does not comprise water"—means a sufficiently small amount of water (liquid or gas) so as to not trigger a positive indication from a moisture indicator.

"Between the can top and the sanitation sheet"—means on the surface of the can top, on the can rim, on the surface of the sanitation sheet facing the can top, or anywhere in the space between the can top and the sanitation sheet.

"Presence of water"—means the presence of liquid water or water vapor.

"Retainer"—the prior art plastic retention top used to hold a group of beverage cans together.

"Hermetic seal"—sufficiently airtight that under normal and proper handling and storage conditions, and no break to the seal, that a contamination indicator will not indicate positive.

Ideal, Ideally, Optimum and Preferred—Use of the words, "ideal," "ideally," "optimum," "optimum," "should" and "preferred," when used in the context of describing this invention, refer specifically a best mode for one or more embodiments for one or more applications of this invention. Such best modes are non-limiting, and may not be the best mode for all embodiments, applications, or implementation technologies, as one trained in the art will appreciate.

May, Could, Option, Mode, Alternative and Feature—Use of the words, "may," "could," "option," "optional," "mode," "alternative," and "feature," when used in the context of describing this invention, refer specifically to various embodiments of this invention. All descriptions herein are non-limiting, as one trained in the art will appreciate.

What is claimed is:

1. A system of providing sanitary beverage cans comprising:

a plurality of filled beverage cans;

a plastic retainer comprising openings suited to firmly enclose the upper portion of each beverage can;

a plastic sanitation sheet;

wherein the sanitation sheet fully covers the tops of the beverage cans;

wherein the plastic retainer is placed over both the sanitation sheet and the beverage cans such that the openings in the plastic retainer grip the upper portion of the beverage cans through the plastic sanitation sheet;

wherein the sanitation sheet is held in place by pressure from the plastic retainer;

a seal between the sanitation sheet and the rim of each can;

a seal indicator located between each can top and the sanitation sheet wherein the seal indicator detects the presence of oxygen.

2. A system of providing sanitary beverage cans comprising:

a plurality of filled beverage cans;

a plastic retainer comprising openings suited to firmly enclose the upper portion of each beverage can;

a plastic sanitation sheet;

wherein the sanitation sheet fully covers the tops of the beverage cans;

wherein the plastic retainer is placed over both the sanitation sheet and the beverage cans such that the openings in the plastic retainer grip the upper portion of the beverage cans through the plastic sanitation sheet;

wherein the sanitation sheet is held in place by pressure from the plastic retainer;

a seal between the sanitation sheet and the rim of each can;

a seal indicator located between each can top and the sanitation sheet wherein the seal indicator detects the presence of water.

3. A system of providing sanitary beverage cans comprising:

a plurality of filled beverage cans;

a plastic retainer comprising openings suited to firmly enclose the upper portion of each beverage can;

a plastic sanitation sheet;

wherein the sanitation sheet fully covers the tops of the beverage cans;

wherein the plastic retainer is placed over both the sanitation sheet and the beverage cans such that the openings in the plastic retainer grip the upper portion of the beverage cans through the plastic sanitation sheet;

wherein the sanitation sheet is held in place by pressure from the plastic retainer;

a contamination indicator located between the can top and the sanitation sheet.

4. The system of claim 3 wherein:

the contamination indicator changes state in the presence of a pH of less than 6.

5. The system of claim 3 wherein:

the contamination indicator changes state in the presence of sugar.

6. The system of claim 3 wherein:

the contamination indicator changes state in the presence of water.

7. The system of claim 3 wherein:

the contamination indicator comprises mold.

8. The system of claim 3 wherein:

the contamination indicator is printed on the sanitation sheet.

9. A article of manufacture comprising:

a plastic sanitation sheet;

wherein the sanitation sheet is configured to be placed between a plurality of beverage cans and a plastic retainer wherein the plastic retainer comprises openings suited to firmly enclose the upper portion of the beverage cans;

wherein the sanitation sheet is configured to fully cover the top of each beverage can;

wherein the sanitation sheet is configured to be placed over the beverage can and the plastic retainer is configured to be placed over both the sanitation sheet and the beverage cans such that the openings in the plastic retainer grip the upper portion of the beverage cans through the plastic sanitation sheet;

wherein the sanitation sheet is configured to then be held in place by pressure from the plastic retainer.

10. A method of sanitary can packaging comprising:

placing a plastic sanitation sheet between a plurality of beverage cans and a plastic retainer wherein the plastic retainer comprises openings configured to firmly enclose the upper portion of the beverage cans such that the sanitation sheet fully covers the top of each beverage can;

pressing the plastic retainer and the beverage cans together such that the openings in the plastic retainer grips the upper portion of each beverage can through the plastic sanitation sheet.

* * * * *